US010685795B2

(12) United States Patent
Wong

(10) Patent No.: US 10,685,795 B2
(45) Date of Patent: Jun. 16, 2020

(54) LOCKING SYSTEM FOR USE WITH A TRIGGER ASSEMBLY OF AN ELECTRICAL DEVICE

(71) Applicants: DEFOND ELECTECH CO., LTD., Guangdong (CN); DEFOND COMPONENTS LIMITED, Chai Wan (HK)

(72) Inventor: Kin Yu Wong, Chai Wan (HK)

(73) Assignees: DEFOND ELECTECH CO. LTD., Dongguan (CN); DEFOND COMPONENTS LIMITED, Hong Kong (CN)

( * ) Notice: Subject to any disclaimer, the term of this patent is extended or adjusted under 35 U.S.C. 154(b) by 0 days.

(21) Appl. No.: 16/112,211

(22) Filed: Aug. 24, 2018

(65) Prior Publication Data

US 2019/0198270 A1 Jun. 27, 2019

(30) Foreign Application Priority Data

Dec. 22, 2017 (HK) ..... 17113719.4

(51) Int. Cl.

| | |
|---|---|
| ***B25F 5/02*** | (2006.01) |
| ***H01H 21/10*** | (2006.01) |
| ***H01H 19/03*** | (2006.01) |
| ***H01H 9/06*** | (2006.01) |
| ***H01H 3/20*** | (2006.01) |
| ***H01H 19/635*** | (2006.01) |

(52) U.S. Cl.

CPC ..... *H01H 19/03* (2013.01); *B25F 5/02* (2013.01); *H01H 3/20* (2013.01); *H01H 9/06* (2013.01); *H01H 19/635* (2013.01); *H01H 21/10* (2013.01); *H01H 2231/048* (2013.01)

(58) Field of Classification Search

CPC ..... H01H 9/06; H01H 3/20; H01H 21/10; H01H 21/06; H01H 19/03

See application file for complete search history.

(56) References Cited

U.S. PATENT DOCUMENTS

| | | | | |
|---|---|---|---|---|
| 4,879,438 | A | 11/1989 | Winchester | |
| 5,136,130 | A | 8/1992 | Daly | |
| 5,638,945 | A * | 6/1997 | Fukinuki | H01H 3/20 200/318 |
| 10,014,128 | B2 | 7/2018 | Kannan et al. | |

(Continued)

FOREIGN PATENT DOCUMENTS

| | | |
|---|---|---|
| CN | 106409563 A | 2/2017 |
| EP | 2 019 399 A2 | 1/2009 |

(Continued)

OTHER PUBLICATIONS

Chinese Search Report dated Dec. 26, 2017 for HK 17113719.4, 6 pages.

(Continued)

*Primary Examiner* — Vanessa Girardi

(74) *Attorney, Agent, or Firm* — Seed Intellectual Property Law Group LLP

(57) ABSTRACT

A trigger assembly for use with an electrical device, including a trigger member, an actuator member operably-connected to the trigger member, and a lock-on mechanism for selectably restricting movement of the trigger member relative to the housing.

9 Claims, 6 Drawing Sheets

(56) References Cited

U.S. PATENT DOCUMENTS

| | | | |
|---|---|---|---|
| 2005/0205406 | A1 | 9/2005 | Wong |
| 2005/0224325 | A1 | 10/2005 | Turley |
| 2016/0322183 | A1 | 11/2016 | Vogel |
| 2017/0194741 | A1 | 7/2017 | Zhang et al. |

FOREIGN PATENT DOCUMENTS

| | | | |
|---|---|---|---|
| EP | 3 338 960 | A1 | 6/2018 |
| EP | 3338960 | A1 | 6/2018 |
| JP | 2005-335005 | A | 12/2005 |
| JP | 2009-056566 | A | 3/2009 |
| JP | 2009-255236 | A | 11/2009 |
| JP | 2017-080844 | A | 5/2017 |
| TW | M371995 | U | 1/2010 |

OTHER PUBLICATIONS

Notification of Reason for Rejection, with English Translation of Summary and Objections, dated Apr. 21, 2020 for JP Patent Application No. 2018-168036, 5 pages.
European Search Report dated Apr. 30, 2020 for EP Patent Application No. 18181738.8-1202, 6 pages.

* cited by examiner

LOCKING SYSTEM FOR USE WITH A TRIGGER ASSEMBLY OF AN ELECTRICAL DEVICE

TECHNICAL FIELD

The present invention relates to locking systems for locking-on and locking-off of a trigger of an electrical device such as a power tool, gardening tool and the like.

BACKGROUND OF THE INVENTION

It is sometimes required that a trigger-operated electrical device, such as an electric power tool, be continuously operated for an extended period of time at a desired speed setting. To alleviate fatigue in the user's finger operating the trigger, a "lock-on" mechanism is provided to allow locking of the power tool at the desired speed of operation without the user having to maintain pressure on the trigger. The same lock-on mechanism may also be configured to serve a dual-function as a "lock-off" mechanism—that is, a mechanism that is selectably movable into a locked-off position in which the trigger is prevented from being squeezed and the electric device is prevented from being turned on. One perceived problem with such dual-purpose lock-on/lock-off mechanisms is that a user may become confused and inadvertently deactivate the lock-off mechanism and allow the electric device to turn on causing harm to the user.

SUMMARY OF THE INVENTION

The present invention seeks to alleviate at least one of the above-described problems.

The present invention may involve several broad forms. Embodiments of the present invention may include one or any combination of the different broad forms herein described.

In a first broad form, the present invention provides a trigger assembly for use with an electrical device, said electrical device having an electrical switch housing with an electrical switch unit disposed therein, the trigger assembly including; a trigger member configured for movement relative to the housing; an actuator member operably-connected to the trigger member and, responsive to movement of the trigger member relative to the housing, said actuator member being movable in a first direction relative to the housing from an OFF position in which the electrical switch is operably-opened by the actuator towards an ON position in which the electrical switch is operably-closed by the actuator, and movable in a second direction relative to the housing from the ON position towards the OFF position; a lock-on mechanism including a first locking member mounted proximate to the trigger member and a second locking member mounted proximate to the housing, wherein when the actuator member is moved in to the ON position, said first and second locking members are selectably movable relative to each other into at least one of a locked configuration whereby the actuator member is locked in the ON position, and, an unlocked configuration whereby the actuator member is not locked in the ON position; and a lock-off mechanism including a lock-off member disposed on the trigger member, said lock-off member being selectably movable between at least one of a locked-off position in which the lock-off member restricts movement of the trigger member relative to the housing and whereby the actuator member is restricted from being moved from the OFF position in to the ON position, and, a non-locked-off position in which the lock-off member does not restrict movement of the trigger member relative to the housing and whereby the actuator member is not restricted from being moved from the OFF position in to the ON position; wherein said lock-on mechanism and lock-off mechanism are separate and independently operable of each other.

Preferably, the first locking member of the lock-on mechanism may be rotatably mounted to the trigger member and may be configured for rotation in a first direction about a rotation axis relative to the trigger member in to the locked configuration whereby the actuator member is locked in the ON position, and, in a second direction about the rotation axis in to the unlocked configuration whereby the actuator member is not locked in the ON position.

Preferably, rotation axis may be substantially perpendicular to a direction of movement of the actuator.

Preferably, the lock-off member of the lock-off mechanism may be slidably mounted to the trigger member and is configured for slidable movement relative to the trigger member along a sliding axis between the locked-off and non-locked-off positions.

Preferably, the sliding axis may be substantially parallel to the rotation axis of the first locking member.

Preferably, the lock-off member may be in the locked-off position when arranged in a relatively central position along the sliding axis and the lock-off member is in the non-locked-off position when arranged in a position along the sliding axis on at least one side of the relatively central position.

Preferably, the lock-off member may be in the non-locked-off position when in a position along the sliding axis on either side of the relatively central position.

Preferably, the lock-off member may include a biasing member configured for urging the lock-off member towards the central position.

Preferably, when the lock-off member is arranged in the locked-off position, it may be configured to restrict movement of the trigger member relative to the housing when at least around 50 pounds of force is applied to the trigger member. Typically, a fastener such as an "E-clip", "E-ring" or the like may be positioned between the lock-off member and the trigger member and may be acted upon by the biasing member so as to move together with the lock-off member. Advantageously, the presence of the fastener between the lock-off member and the trigger member may assist in withstanding the force applied to the trigger member when the lock-off member is arranged in the locked-off position.

Preferably, the trigger member may be hingedly coupled relative to the housing and may include a biasing member configured for biasing movement of the trigger member about the hinge whereby the actuator is urged towards the OFF position.

In another broad form, the present invention provides a locking system for use with a trigger assembly of an electrical device, said electrical device having: an electrical switch housing with an electrical switch unit disposed therein; a trigger member configured for movement relative to the housing; an actuator member operably-connected to the trigger member and, responsive to movement of the trigger member relative to the housing, said actuator member being movable in a first direction relative to the housing from an OFF position in which the electrical switch is operably-opened by the actuator towards an ON position in which the electrical switch is operably-closed by the actuator, and movable in a second direction relative to the housing from the ON position towards the OFF position; said locking system including: a lock-on mechanism including a first locking member mounted proximate to the trigger member and a second locking member mounted proximate to the housing, wherein when the actuator member is moved in to the ON position, said first and second locking members are selectably movable relative to each other into at least one of a locked configuration whereby the actuator member is locked in the ON position, and, an unlocked configuration whereby the actuator member is not locked in the ON position; and a lock-off mechanism including a lock-off member disposed on the trigger member, said lock-off member being selectably movable between at least one of a locked-off position in which the lock-off member restricts movement of the trigger member relative to the housing and whereby the actuator member is restricted from being moved from the OFF position in to the ON position, and, a non-locked-off position in which the lock-off member does not restrict movement of the trigger member relative to the housing and whereby the actuator member is not restricted from being moved from the OFF position in to the ON position; wherein said lock-on mechanism and lock-off mechanism are separate and independently operable of each other.

BRIEF DESCRIPTION OF THE DRAWINGS

The present invention will become more fully understood from the following detailed description of a preferred but non-limiting embodiments thereof, described in connection with the accompanying drawings, wherein.

DETAILED DESCRIPTION OF THE PREFERRED EMBODIMENTS

Figure 1:
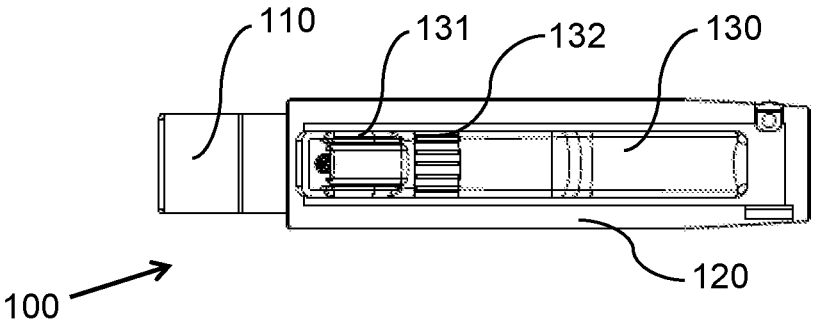
FIG. 1 shows a top view of a trigger assembly of an electrical device in accordance with a first embodiment of the present invention.
Figure 2:
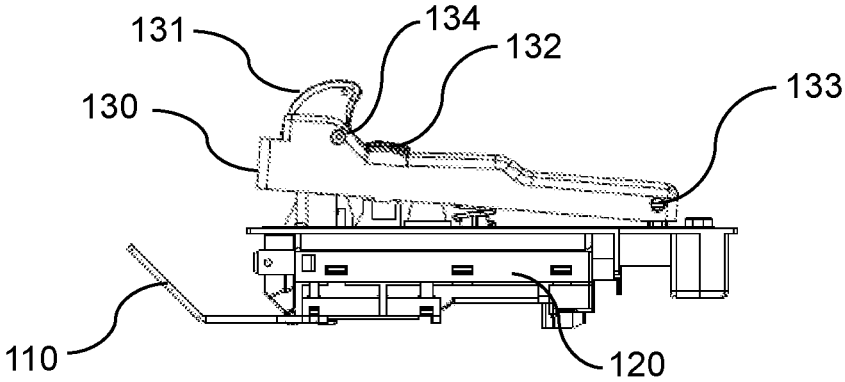
FIG. 2 shows a side-view of the first embodiment of the present invention.
Figure 3:
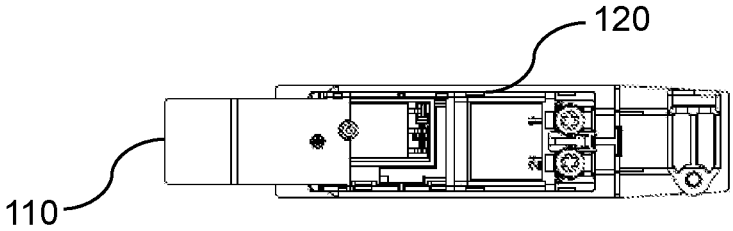
FIG. 3 shows a bottom view of the first embodiment of the present invention.
Figure 4:
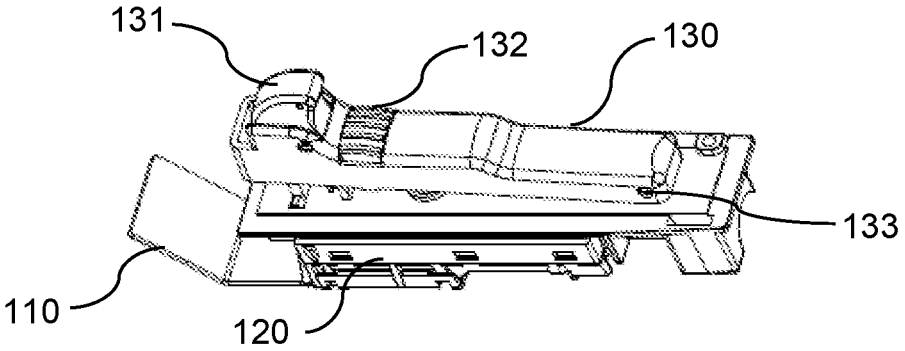
FIG. 4 shows a perspective view of the first embodiment of the present invention.
Figure 5:
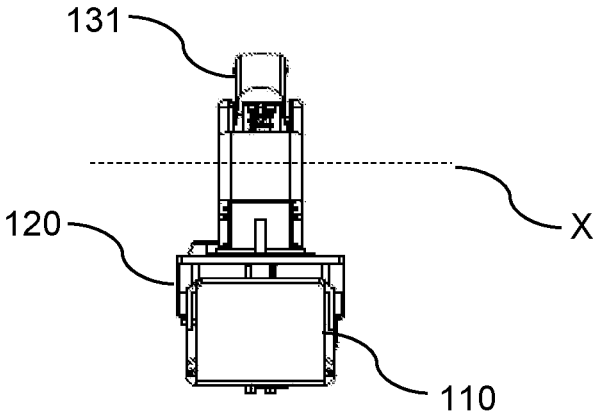
FIG. 5 shows a front view of the first embodiment of the present invention
Figure 6:
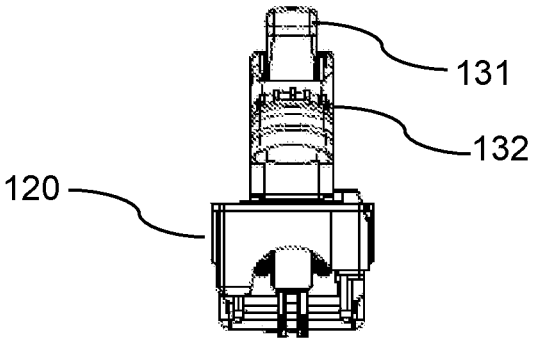
FIG. 6 shows a rear view of the first embodiment of the present invention.
Figure 7:
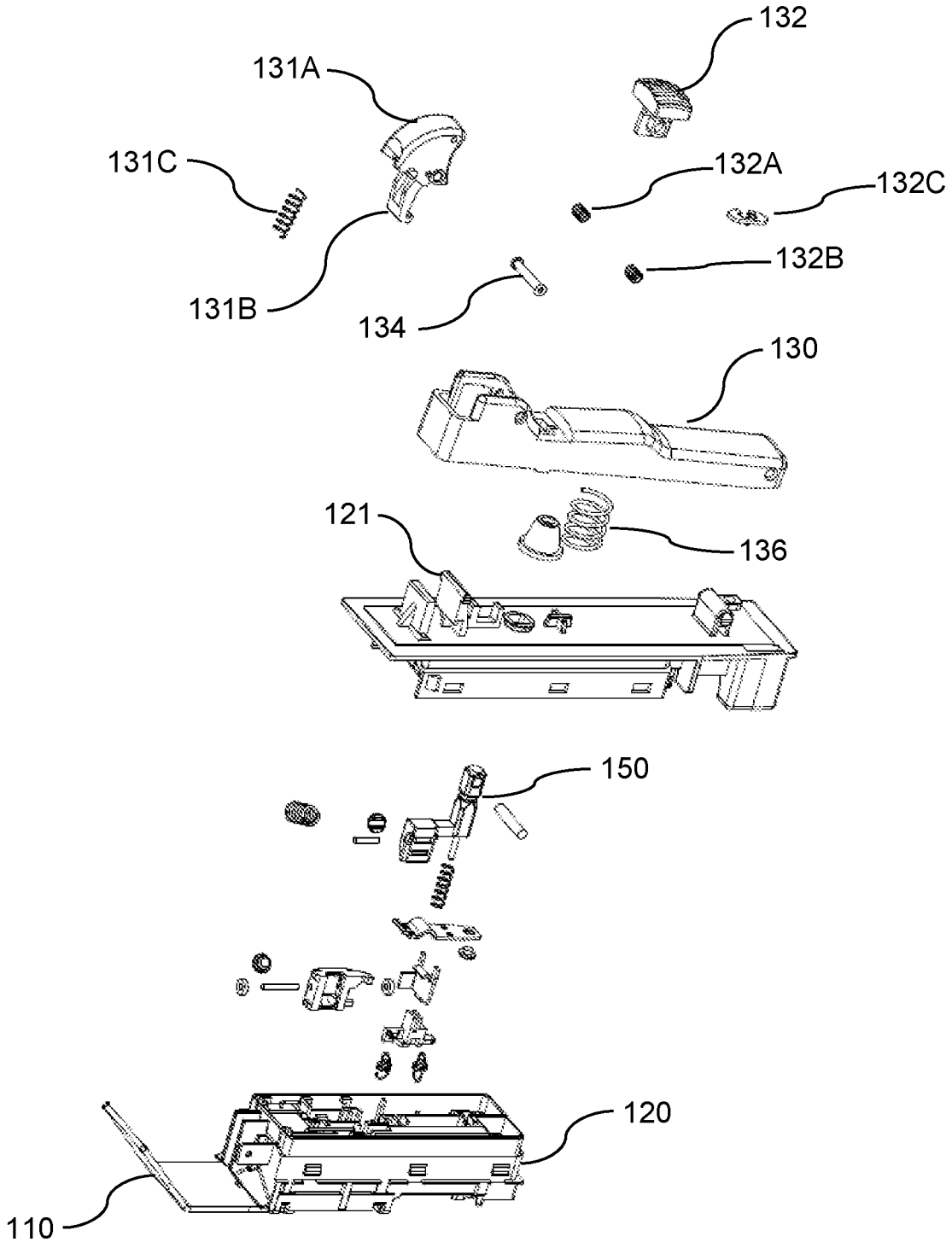
FIG. 7 shows an exploded view of the first embodiment of the present invention.
Figure 8A:
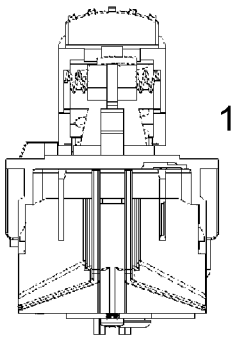
FIG. 8A shows a front cut-away view of the first embodiment of the present invention when a trigger member of the trigger assembly is not squeezed inwardly toward the housing and the actuator member is arranged in the OFF position whereby it operably-opens an electrical switch unit in the electrical switch housing
Figure 8B:
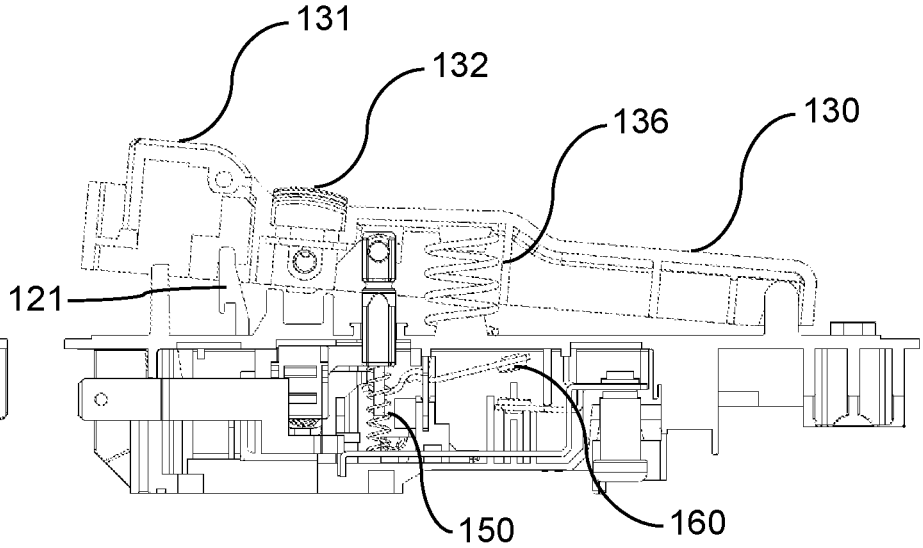
FIG. 8B shows a side cut-away view of the first embodiment of the present invention when the trigger member of the trigger assembly is not squeezed inwardly toward the housing and the actuator member is arranged in the OFF position whereby it operably-opens an electrical switch unit in the electrical switch housing.
Figure 8C:
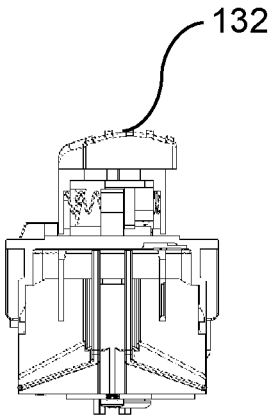
FIG. 8C shows a front cut-away view of the first embodiment of the present invention when the trigger member of the trigger assembly is squeezed inwardly toward the housing and the actuator member is arranged in the ON position whereby it operably-closes the electrical switch unit in the electrical switch housing.
Figure 8D:
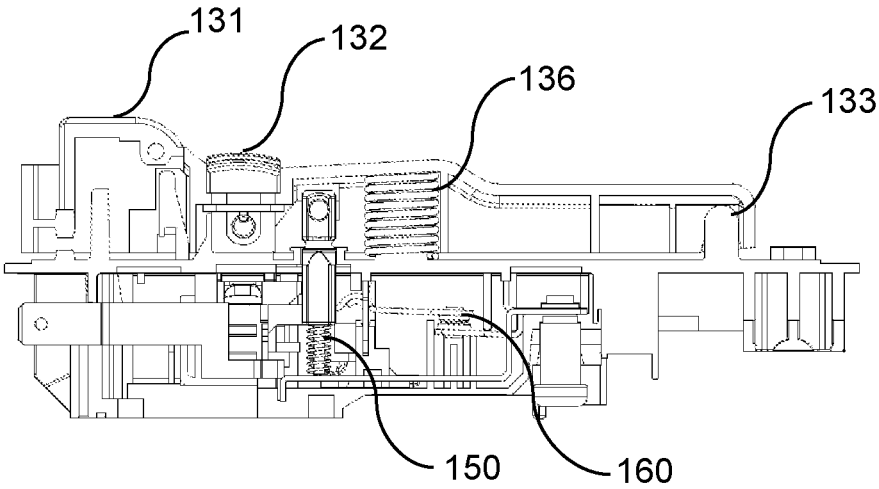
FIG. 8D shows a side cut-away view of the first embodiment of the present invention when the trigger member of the trigger assembly is squeezed inwardly toward the housing and the actuator member is arranged in the ON position whereby it operably-closes the electrical switch unit in the electrical switch housing.

Preferred embodiments of the present invention will now be described herein with reference to FIGS. 1 to 11. The embodiments comprise a variable-speed trigger assembly (100) for use with an electric power tool having an electric motor including for instance an electric drill, grinder, sander, saw, rotary driving tool and the like. More particularly, the embodiments described herein comprise variable-speed trigger assemblies having a locking system to provide both lock-on and lock-off functions. It would be appreciated and understood that whilst this embodiment is described for use with an electric power tool, this is merely for purposes of illustrating functionality and alternate embodiments of the present invention may of course be used with other types of electric devices such as gardening tools.

The variable-speed trigger assembly (100) includes a hand-operable trigger member (130) that is rotatably movable about a hinge (133) relative to an electrical switch housing (120). A return spring (136) biases the trigger member (130) so that it is urged in a direction away from the housing (120). The housing (120) is molded from a rigid plastic material and is mounted on a body (110) of the electric power tool near to a handle of the electric power tool. The housing (120) encloses an electrical switch unit (160) comprising movable and stationary electrical switching contacts (160) that are arranged in series in an electrical circuit between a brushless DC motor and a DC power source (e.g. a battery pack) of the electric power tool.

The trigger member (130) is also operably-connected to an actuator member (150) whereby, when the trigger member (130) is squeezed towards the housing (120), the actuator member (150) is configured to move in a direction inwardly of the housing (120) from an OFF position towards an ON position. When the user's hand releases the trigger member (130), the return spring (136) urges the trigger member (130) in a direction away from the housing (120), and consequently, the actuator member (150) is also caused to move in a direction outwardly of the housing (120) from the ON position toward the OFF position. The actuator-member (120) is operably-connected to the electrical switching contacts (160) such that in response to the actuator member (150) being moved in to the ON position, the electrical switching contacts (160) are moved in to a closed-circuit arrangement whereby power from the DC power source can be supplied to the brushless DC motor via the pair of electrical switching contacts (160). Conversely, in response to the actuator member (150) being moved back in to the OFF position by movement of the trigger member (130) away from the housing (120), the pair of electrical switching contacts (160) are moved in to an opened-circuit configuration whereby the DC power source is not able to supply power to the brushless DC motor via the pair of electrical switching contacts (160). The actuator member (150) is also movable through a range of ON positions inwardly of the housing (120) depending upon the amount of squeezing force applied to the trigger member (130) by the user's hand and the DC motor is configured to operate at variable speeds of operation depending upon the degree of movement of the actuator member (150) inwardly of the housing. It would be understood that in the embodiments described herein, a hinged trigger member is utilised which is configured to move rotatably about the hinge relative to the housing. However, in alternate embodiments, the trigger member may be configured in a pistol-type trigger or any other type of trigger configured for movement relative to the housing other than by rotational or sliding movement.

The lock-on mechanism of the locking system obviates the need for the user to keep squeezing the trigger member (130) at any given speed setting position of the trigger member (130) in order to maintain operation of the electric power tool at that speed of operation. The lock-on mechanism includes a first locking member (131) that is rotatably mounted about another hinge (134) located on the trigger member (130), and, a second locking member (121) that is rigidly mounted on the electric power tool body next to the housing (120). When the trigger member (130) has been squeezed towards the housing (120) and the actuator member (150) has been operably-moved in to the ON position by movement of the trigger member (130), the first locking member (131) of the lock-on mechanism may then be rotated about the hinge (134) in a first direction into a locked configuration with the second locking member (121). The first locking member (131) includes a user contact surface (131A), for instance configured for the user's thumb to control rotational movement of the first locking member (131) about the hinge (134). The user contact surface may include ribbing or other surface texture disposed thereon to allow for gripping by the user's thumb. The first locking member (131) may include a first shaped-portion (131B) that is configured for releasably latching on to a suitably configured second shaped-portion (121) on the second locking member (121) when the first locking member (131) is rotated about the trigger member (130) in to the locked configuration. When in the locked configuration, a return spring (131C) of the first locking member (131) assists in urging the first-shaped portion (131B) of the first locking member (131) against the second shaped-portion (121) of the second locking member (121) so that they may remain in the locked configuration even when the user stops squeezing the trigger member (130). Consequently, the actuator member (150) remains locked in the ON position indefinitely.

Thereafter, the first locking member (131) may be moved out of the locked configuration with the second locking member (121) by squeezing the trigger member (130) towards the housing (120) again such that the first shaped-portion (131B) on the first locking member (131) may unlatch itself from the second shaped-portion (121) on the second locking member (121) and then be free to rotate in a second (e.g. reverse) direction about the hinge (134) in to an unlocked configuration with the second locking member (121). In the unlocked configuration, when the user ceases squeezing of the trigger member (130), the trigger member (130) is able to freely rotate about the hinge (133) away from the housing (120) by urging of the trigger member return spring (136), and in turn, the actuator member (150) that is operably-connected to the trigger member (130) is also moved in a direction outwardly of the housing (120) from the ON position in to the OFF position.

In this embodiment, the axis of rotation (X) about which the first locking member (131) rotates is substantially perpendicular to a direction of movement of the actuator member (150). However, the direction and orientation of rotation of the first locking member (131) may be varied if desired. Furthermore, in certain embodiments, the lock-on mechanism may be implemented using other suitable arrangements, such as for instance, using a spring-loaded first locking member (131) that is configured for slidable movement relative to the second locking member (121) in order to the interlocked configuration with the second locking member (121).

The lock-off mechanism of the locking system includes a lock-off member (132) disposed on the trigger member (130). The lock-off member (132) is selectably movable between a locked-off position in which the lock-off member (132) restricts movement of the trigger member (132) relative to the housing (120) and whereby the actuator member (150) is restricted from being moved from the OFF position in to the ON position, and, a non-locked-off position in which the lock-off member does not restrict movement of the trigger member (130) relative to the housing (120) and whereby the actuator member (150) is not restricted from being moved from the OFF position in to the ON position. In this embodiment, a shaped portion extending from the housing may be configured to prevent movement of the lock-off member in a direction towards the housing when the lock-off member is slidably arranged in the relatively central locked-off position along the sliding axis (Y). That is, as shown in FIG. 9, the lock-off member is not able to move downwardly towards the housing and consequently, this restricts rotational movement of the trigger member towards the housing as well.

Figure 10:
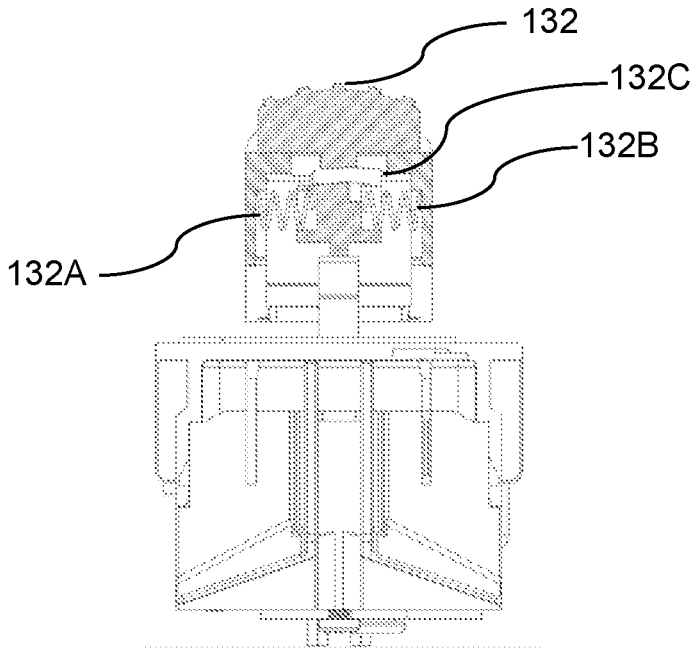
FIG. 10 shows a front cut-away view of the first embodiment the present invention depicting the lock-off mechanism in greater detail.
Figure 11:
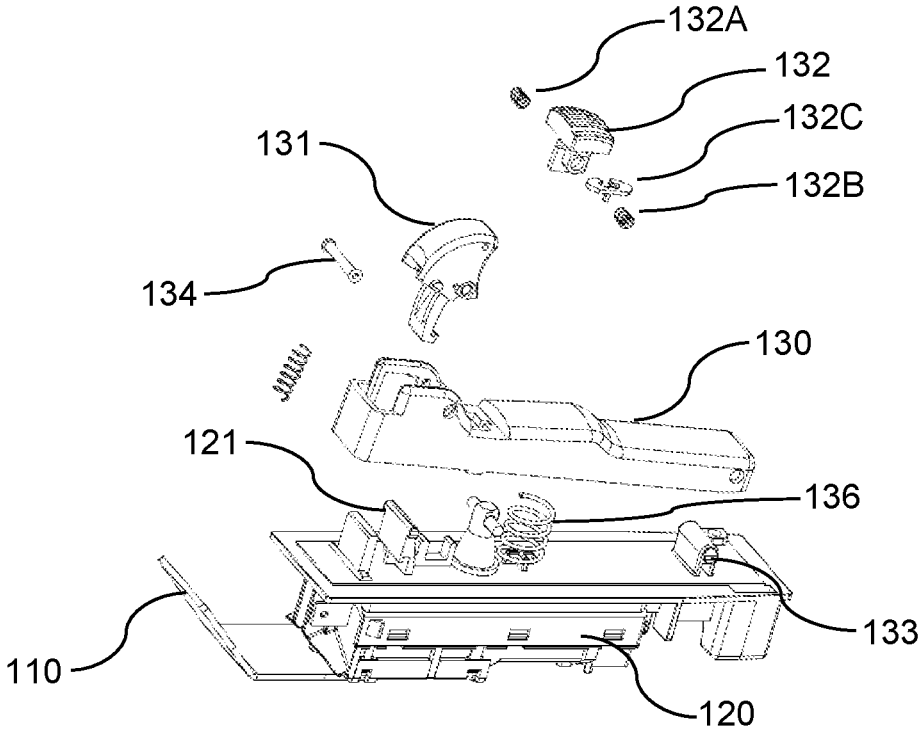
FIG. 11 shows an exploded perspective view of the first embodiment of the present invention.

The lock-off member (132) of the lock-off mechanism is slidably mounted to the trigger member (130) and is configured for slidable movement relative to the trigger member (130) along a sliding axis (Y) between the locked-off and non-locked-off positions. In these embodiments, the sliding axis (Y) is substantially parallel to the rotation axis (X) of the first locking member (131) about its hinge (134). The lock-off member (132) is in the locked-off position when arranged in a relatively central position along the sliding axis (Y) and the lock-off member (132) is in the non-locked-off position when slidably arranged in a position along the sliding axis (Y) on either side of the relatively central position. As shown in FIGS. 10 and 11, the lock-off mechanism includes two return springs (132A,132B) mounted on either side of the lock-off member (132) and which extend in substantially axial alignment with the sliding axis (Y) of the lock-off member (132). The return springs (132A,132B) are configured to urge the lock-off member (132) in to the relatively central position along the sliding axis (Y) as a default position. The lock-off member (132) is slidably mounted on the trigger member (130) next to the first locking member (131) of the lock-on mechanism so that a user's thumb may conveniently contact and operate both the lock-on and lock mechanisms without having to adjust positioning of the user's hand on the trigger member (130) in use. The lock-off member (132) is also rated to withstand forces of at least around 50 pounds applied to the trigger member (130) when arranged in the locked-off position. A metal fastener (132C) such as an "E-clip", "E-ring" or the like is clipped in to position around a stem of the lock-off member (132) between the lock-off member (132) and the trigger member (130) and is acted upon by the return springs (132A,132B) so as to move the fastener (132C) together with the lock-off member (132). Advantageously, the presence of the fastener (132C) between the lock-off member (132) and the trigger member (130) may assist in withstanding the force applied to the trigger member (130) when the lock-off member (132) is arranged in the locked-off position.

Figure 9:
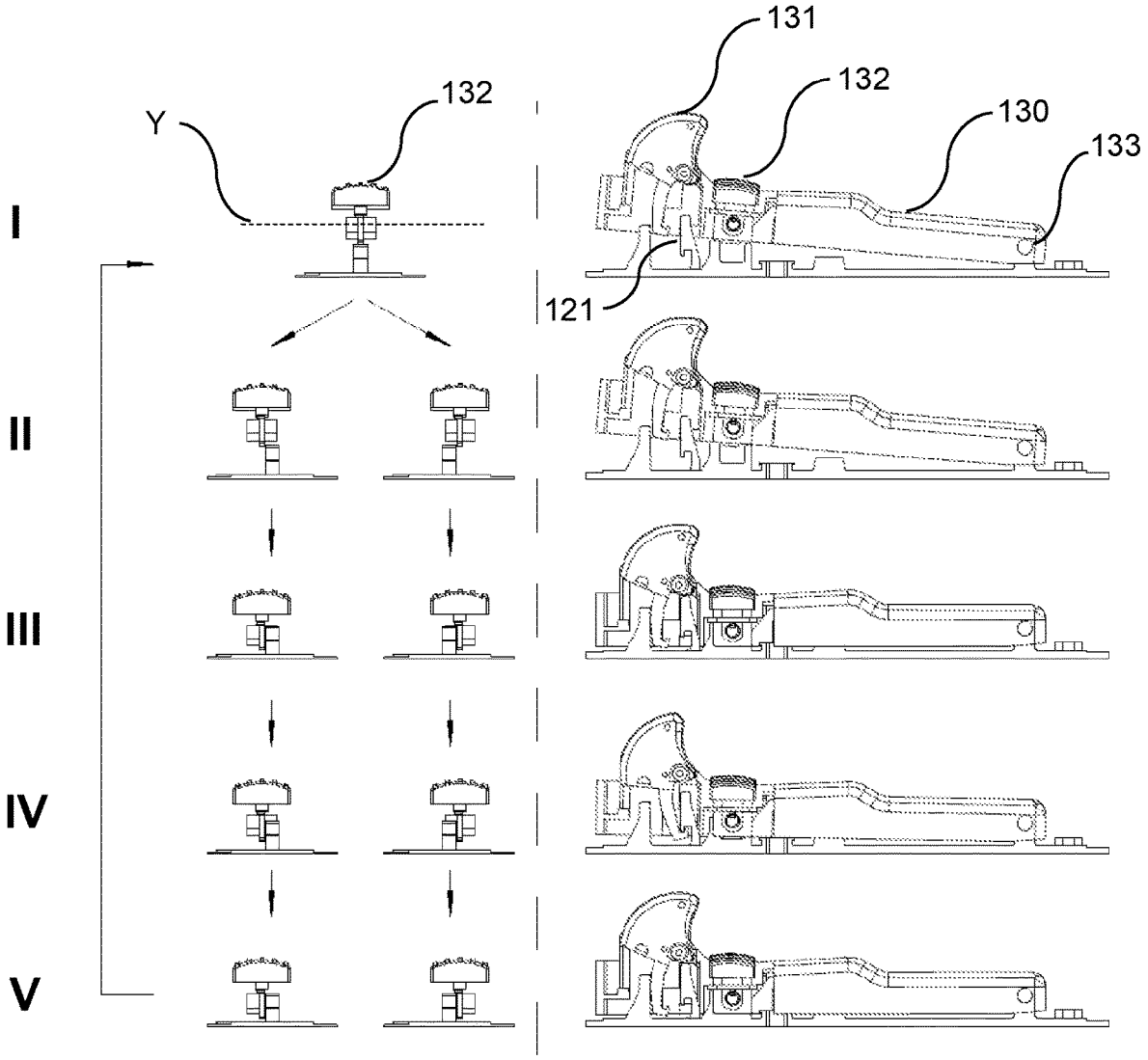
FIG. 9 illustrates operation of a lock-off mechanism in accordance with the first embodiment of the present invention.

FIG. 9 depicts example steps (I-V) in the operation of the lock-off mechanism. In FIG. 9, step I involves the lock-off member (132) being arranged in a relatively central position along the sliding axis (Y) whereby the lock-off member (132) restricts rotational movement of the trigger member (130) about the hinge (133) towards the housing (120). In FIG. 9, step II involves the lock-off member (132) shown being slidably moved on either side of the central position along the sliding axis (Y). In this non-locked-off position, the trigger member (130) is ready and able to now be squeezed against the housing (120) without restriction by the lock-off member (132). In FIG. 9, step III involves the trigger member (130) being rotated towards the housing (120) and, as is depicted in the far right of the image, the first locking member (131) of the lock-on mechanism being arranged in an unlocked configuration with the second locking member (121) so that the trigger member (130) may still freely rotate away from the housing (120) if the user's releases its grip upon the trigger member (130). In FIG. 9, step IV shows the position of the lock-off member (132) slightly raised higher than as shown in step III as the first locking member (131) of the lock-on mechanism has been rotated about in to the locked configuration with the second locking member (121) and the return spring (131C) of the first locking member (131) urges the first shaped-portion (131B) of the first locking member (131) upwardly into latching engagement with the second-shaped portion (121) of the second locking member (121). In FIG. 9, step V the position of the lock-off member (132) is slightly lower than as shown in step IV as the trigger member (130) has been squeezed towards the housing (120) acting against the trigger member (130) return spring (136) to allow the first shaped-portion (131B) on the first locking member (131) of the lock-on mechanism to unlatch itself from the second shaped-portion (121) on the second locking member (121) of the lock-on mechanism. As can be seen, the first locking member (131) of the lock-on mechanism is rotated away from the second locking member (121) into the unlocked configuration whereby the trigger member (130) may now freely rotate about the hinge (133) away from the housing (120) again by urging of the return spring (136).

In view of the above, it will be apparent that embodiments of the present invention herein described may assist in providing various advantages. In particular, the locking system conveniently provides both a lock-on and lock-off mechanism that are located proximate to each other such that the user may operate single-handedly and without having to adjust positioning of the user's hand. Furthermore, the lock-on and lock-off mechanisms are comprised by separate mechanisms that are independently operable. This provides a safety feature in that it reduces the risk of a user inadvertently activating the power tool by deactivating the lock-off mechanism. Yet further, as the lock-off mechanism may be slidably moved to either side of the central locked-off position, this may assist in accommodating both left-handed and right-handed users.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A locking system for use with a trigger assembly of an electrical device, said electrical device having:

an electrical switch housing with an electrical switch unit disposed therein;

a trigger member configured for movement relative to the housing;

an actuator member operably-connected to the trigger member and, responsive to movement of the trigger member relative to the housing, said actuator member being movable in a first direction relative to the housing from an OFF position in which the electrical switch is operably-opened by the actuator towards an ON position in which the electrical switch is operably-closed by the actuator, and movable in a second direction relative to the housing from the ON position towards the OFF position;

said locking system including:

a lock-on mechanism including a first locking member mounted proximate to the trigger member and a second locking member mounted proximate to the housing, wherein when the actuator member is moved in to the ON position, said first and second locking members are selectably movable relative to each other into at least one of a locked configuration whereby the actuator member is locked in the ON position, and, an unlocked configuration whereby the actuator member is not locked in the ON position;

a lock-off mechanism including a lock-off member disposed on the trigger member, said lock-off member being selectably movable between at least one of a locked-off position in which the lock-off member restricts movement of the trigger member relative to the housing and whereby the actuator member is restricted from being moved from the OFF position in to the ON position, and, a non-locked-off position in which the lock-off member does not restrict movement of the trigger member relative to the housing and whereby the actuator member is not restricted from being moved from the OFF position in to the ON position; and said lock-off member of the lock-off mechanism being slidably mounted to the trigger member and configured for slidable movement relative to the trigger member along a sliding axis between the locked-off and non-locked-off positions, said sliding axis being substantially parallel to a rotation axis of the first locking member, and wherein said lock-on mechanism and lock-off mechanism are separate and independently operable of each other.

2. A trigger assembly for use with an electrical device, said electrical device having an electric switch housing with an electrical switch unit disposed therein, the trigger assembly including:

a trigger member configured for movement relative to the housing;

an actuator member operably-connected to the trigger member and, responsive to movement of the trigger member relative to the housing, said actuator member being movable in a first direction relative to the housing from an OFF position in which the electrical switch is operably-opened by the actuator towards an ON position in which the electrical switch is operably-closed by the actuator, and movable in a second direction relative to the housing from the ON position towards the OFF position;

a lock-on mechanism including a first locking member mounted proximate to the trigger member and a second locking member mounted proximate to the housing, wherein when the actuator member is moved in to the ON position, said first and second locking members are selectably movable relative to each other into at least one of a locked configuration whereby the actuator member is locked in the ON position, and, an unlocked configuration whereby the actuator member is not locked in the ON position;

a lock-off mechanism including a lock-off member disposed on the trigger member, said lock-off member being selectably movable between at least one of a locked-off position in which the lock-off member restricts movement of the trigger member relative to the housing and whereby the actuator member is restricted from being moved from the OFF position in to the ON position, and, a non-locked-off position in which the lock-off member does not restrict movement of the trigger member relative to the housing and whereby the actuator member is not restricted from being moved from the OFF position in to the ON position;

wherein the lock-off member of the lock-off mechanism slidably mounted to the trigger member and configured for slidable movement relative to the trigger member along a sliding axis between the locked-off and non-locked-off positions, and sliding axis is substantially parallel to a rotation axis of the first locking member, and wherein said lock-on mechanism and lock-off mechanism are separate and independently operable of each other.

3. A trigger assembly as claimed in claim 2 wherein when the lock-off member is arranged in the locked-off position, it is configured to restrict movement of the trigger member relative to the housing when at least around 50 pounds of force is applied to the trigger member.

4. A trigger assembly as claimed in claim 2 wherein the trigger member is hingedly coupled relative to the housing and includes a biasing member configured for biasing movement of the trigger member about the hinge whereby the actuator is urged towards the OFF position.

5. A trigger assembly as claimed in claim 2 wherein the first locking member of the lock-on mechanism is rotatably mounted to the trigger member and is configured for rotation in a first direction about the rotation axis relative to the trigger member in to the locked configuration whereby the actuator member is locked in the ON position, and, in a second direction about the rotation axis in to the unlocked configuration whereby the actuator member is not locked in the ON position.

6. A trigger assembly as claimed in claim 5 wherein the rotation axis is substantially perpendicular to a direction of movement of the actuator.

7. A trigger assembly as claimed in claim 2 wherein the lock-off member is in the locked-off position when arranged in a relatively central position along the sliding axis and the lock-off member is in the non-locked-off position when arranged in a position along the sliding axis on at least one side of the relatively central position.

8. A trigger assembly as claimed in claim 7 wherein the lock-off member is in the non-locked-off position when in a position along the sliding axis on either side of the relatively central position.

9. A trigger assembly as claimed in claim 7 wherein the lock-off member includes a biasing member configured for urging the lock-off member towards the central position.

* * * * *